United States Patent [19]

Auberry

[11] 4,233,758

[45] Nov. 18, 1980

[54] FOOTWEAR

[75] Inventor: Horace Auberry, Waynesville, N.C.

[73] Assignee: Ro-Search, Inc., Waynesville, N.C.

[21] Appl. No.: 15,660

[22] Filed: Feb. 27, 1979

[51] Int. Cl.[3] ..... A43B 7/06; A43D 21/00

[52] U.S. Cl. ..... 36/3 A; 12/145

[58] Field of Search ..... 36/3 R, 3 A, 3 B, 17 R, 36/17 PW, 12; 12/145

[56] References Cited

U.S. PATENT DOCUMENTS

| | | | |
|---|---|---|---|
| 1,600,620 | 9/1926 | Buck | 36/3 A |
| 2,751,692 | 6/1956 | Cortina | 36/3 R |
| 3,006,084 | 10/1961 | LeCompte | 36/3 A |
| 4,073,023 | 2/1978 | Liebscher et al. | 12/145 |

*Primary Examiner*—Patrick D. Lawson

*Attorney, Agent, or Firm*—Dos T. Hatfield

[57] ABSTRACT

Ventilated footwear formed of an upper of impermeable material having its lower margin spaced from the upper surface of the sole, whether inner or tread sole, and socklining, to provide a space for ventilation, and the upper is secured to the sole by means including a rim of permeable material.

5 Claims, 3 Drawing Figures

FOOTWEAR

BACKGROUND OF THE INVENTION

Figure 1:
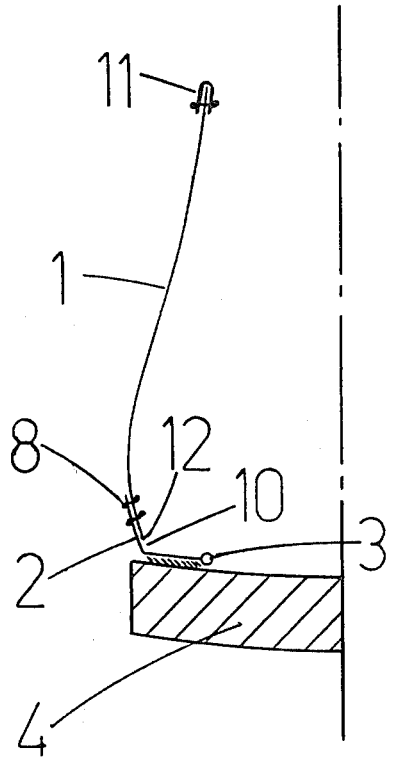

In the manufacture of footwear it is customary to last the upper material over a last. This is especially needed when uppers of leather are used, because such leather has no uniform stretch. Lasting is performed either on machines attaching the upper to an insole, most of the time while over the last, a replica of the human foot, or by using a last that is part of a molding machine. When using molding machines, one can dispense with the use of insoles or socklinings and obtain the tightening of the upper over the last by means of a welt-like strip, as described in U.S. Pat. No. 4,073,023 in which I appear as co-inventor.

Recent developments in the hide and leather market have resulted in a markable increase in the price of leather, which has led the footwear industry to adopt man-made materials as a substitute of the leather of the upper. The consumer, however, complains that such man-made materials, especially plastics supported by fabric yard material, are hot on the foot, although the use of such textile-supported plastics allow manufacturers to keep prices at a lower level than would be the case if, in today's market, leather would be used.

SUMMARY

This invention provides certain advantages. The major portion of the upper or footwear according to this invention is made from impermeable material. It attempts, however, to give the wearer of the footwear the comfort to which he is used when wearing footwear with uppers of leather. It eliminates the heat generated upon the wearer's foot by the use of impermeable material and simultaneously provides for breathable leathers, such as split leather or other permeable material, to be in contact with the lower part of the wearer's foot. Split leather for the permeable material is preferred because it has open pores. Furthermore, split leather, which, by definition, is leather in which the grain of the leather has been removed, is suitable for easy bonding with the soles of footwear by the known sole-laying process or by molding of elastomeric materials onto such split leather. There is, consequently, no need for an operation referred to as "roughening" on the margin of the upper which is to adhere to the sole.

To obtain these advantages, the upper is prepared in two parts. The major portion of the upper can be made of impermeable materials. Such materials can be elastomers, such as PVC, supported by textile. It is preferred, however, to use polyurethane upper materials likewise supported by textile, because such material, being considerably thinner than PVC-coated textiles and being, furthermore, slightly blown, conforms better to the lasts used in the manufacture of footwear according to the invention.

The other part of the upper and, more particularly, the one coming in contact with the sole, is made of split leather, stitched, molded, or otherwise secured to the fragmented upper, which I propose to use. By reason of the split leather, the foot of the wearer can breathe. A further advantage is that split leather has a natural tendency to give and stretch and thereby increases the feeling of comfort of the wearer whose foot is not surrounded by an air-tight upper as is the case when footwear is entirely made from textile-supported elastomeric materials, the elastomeric material representing the visible or outside of the footwear. Such footwear has no ventilation. The split leather rim may be considered a marginal portion of the upper extending both below and above the insole level of the footwear. The upper provided with a rim may be cemented to an insole or otherwise fastened to such insole. The upper provided with a rim may also be stringlasted or connected with a socklining by means of stitching. All of the known processes for lasting an upper, whether referred to as "stringlasting", "force lasting", "insoling", "cement lasting", or "tack lasting", are known in the trade. The rim attached to the upper may also be folded towards the outside. In that case, adhesion to the outsole or an intermediary midsole is obtained to that side of the rim otherwise invisible when the shoe is worn.

Adhesion between the upper to which the rim is attached and the sole may also be obtained by the use of a welt-like strip attached to the rim and following the teachings of U.S. Pat. No. 4,073,023.

Figure 2:
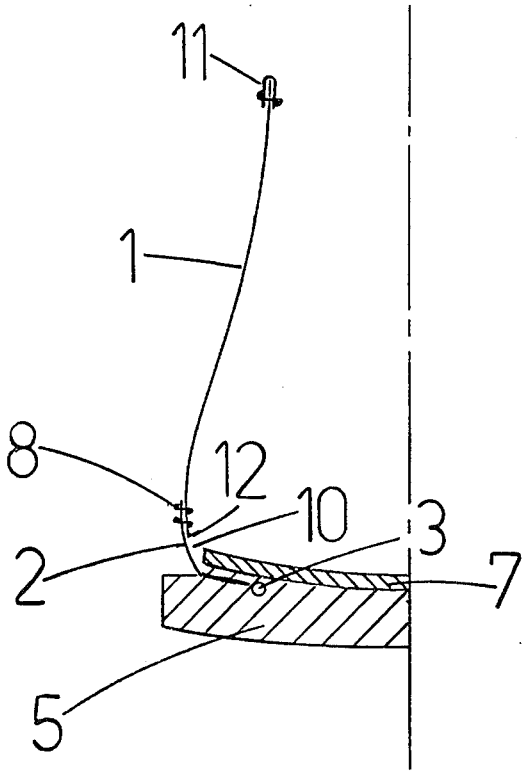
Figure 3:
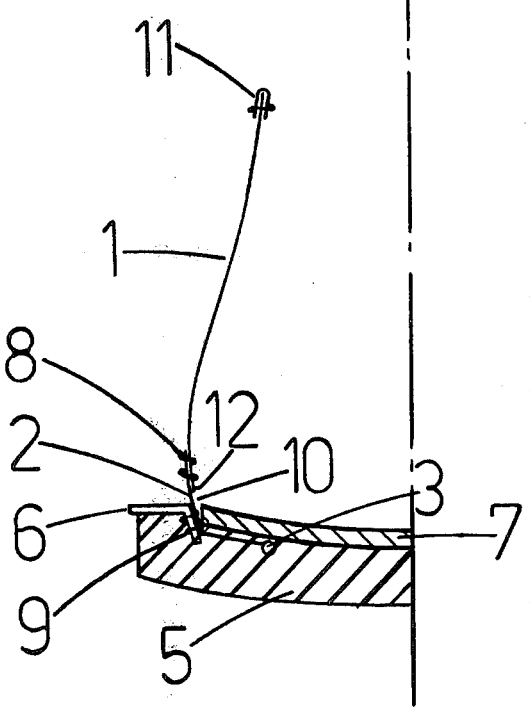

The following is a description, by way of example, of some embodiments of the present invention with reference to the accompanying diagrammatic or fragmentary drawings:

FIG. 1 is a diagrammatical cross-sectional view of part of a shoe to which a sole has been attached by means of a sole-laying operation using cement;

FIG. 2 is a diagrammatical cross-sectional view of part of a shoe made by the direct molding process using an elastomeric material for the main body of the sole, bonded to the rim of split leather; and FIG. 3 is a diagrammatical cross-sectional view of part of a shoe in which the elastomeric sole is molded to a compatible strip attached to the rim, prior to trimming the strip, thereby giving the footwear its final and desired appearance.

In the reproduction of parts of the shoe, the upper of elastomeric material supported by textile 1 is provided with the rim of split leather 2 by stitches 8. The string 3 is used for stringlasting. An outsole 4, premolded or cut out of outsole material, whether leather or elastomeric material is shown in FIG. 1. A tread sole 5 formed in situ is shown in FIGS. 2 and 3. A strip 6, sometimes referred to as a welt, is shown in FIG. 3, secured to the tread sole by molding or the like and is secured to the rim 2 by stitches 9. 12 represents the lower edge of the upper 1, and 11, the upper edge of the fragmentary upper 1, which may be either bound or folded over.

In determining to what extent the upper of elastomeric material can be abbreviated, it is important to limit the upper so that it does not extend further towards the insole level of the shoe than $\frac{1}{8}$ of an inch. This gives ample ventilation if a compressible socklining 7 is used. In case a socklining supported by a stiffer material is used, care should be taken to provide for at least $\frac{1}{8}$ of an inch of "free-breathing" space 10 between the upper surface of the socklining 7 and the lower edge 12 of the fragmentary upper 1. Given the less heat-sensitive nature of a wearer's heel, the foregoing requirements do not apply to the portion of the shoe heel where the stiffner or counter may be fully lasted, i.e. be underneath the insole level.

Footwear as described can be adorned or perforated. The upper 1 can be made in shapes corresponding to parts of a boot, slipper, or a regular walking shoe. The uppers of elastomeric materials supported by textiles may also be provided with impressions, whether subsequently secured by stitches or in a manner known in the trade. The uppers provided with a rim may be premolded, mulled, or heat-set, prior to making them into footwear.

What is claimed is:

1. Footwear comprising an upper, a tread sole of elastomeric material, said upper being formed of impermeable material and extending downwardly toward but spaced from the upper portion of said sole, a rim of permeable material secured adjacent to the lower margin of said upper and bonded to said sole and having a portion thereof covering at least a portion of said space, said space between the bottom margin of said upper and sole providing ventilation for the footwear through said permeable rim.

2. Footwear as claimed in claim 1 further characterized in that said rim is formed of split leather.

3. Footwear as claimed in claim 1 further characterized in that said upper includes elastomeric material.

4. Footwear as claimed in claim 1 wherein said rim is secured adjacent to the bottom margin of said upper by stitching.

5. Footwear as claimed in claim 1 further including a socklining positioned above said tread sole and a portion of said rim.

* * * * *